US005980733A

United States Patent [19]

Collins et al.

[11] Patent Number: 5,980,733

[45] **Date of Patent: *Nov. 9, 1999**

[54] METHOD OF REMOVING SULFUR COMPOUNDS FROM HYDROCARBON STREAMS

[75] Inventors: Bevan C. Collins, Bartlesville, Okla.; Nicholas J. Savaiano, Westmont; Pat A. Mestetsky, St. Charles, both of Ill.

[73] Assignee: United Laboratories International, Duncan, Okla.

[ * ] Notice: This patent is subject to a terminal disclaimer.

[21] Appl. No.: 09/133,929

[22] Filed: Aug. 13, 1998

Related U.S. Application Data

[63] Continuation-in-part of application No. 08/541,611, Oct. 10, 1995, Pat. No. 5,807,476, which is a continuation-in-part of application No. 08/228,575, Apr. 15, 1994, Pat. No. 5,462,607.

[51] Int. Cl.[6] ..... C10G 29/20

[52] U.S. Cl. ..... 208/236; 208/47; 208/348; 44/301; 44/5; 585/950; 423/242.1; 423/242.7

[58] Field of Search ..... 208/236, 47, 347, 208/348; 423/242.7, 242.1; 585/950

[56] References Cited

U.S. PATENT DOCUMENTS

| | | | |
|---|---|---|---|
| 3,457,168 | 7/1969 | Malmberg | 210/21 |
| 3,740,315 | 6/1973 | Li | 195/2 |
| 4,415,662 | 11/1983 | Thirumalachar | 435/176 |
| 4,539,100 | 9/1985 | Ronden | 208/188 |
| 4,628,836 | 12/1986 | Littmann | 110/343 |
| 4,739,041 | 4/1988 | Morrow | 530/504 |
| 4,821,757 | 4/1989 | Hayes | 137/13 |
| 4,886,519 | 12/1989 | Hayes | 44/51 |
| 5,084,160 | 1/1992 | Stewart | 208/428 |
| 5,358,870 | 10/1994 | Monticello | 435/282 |
| 5,385,842 | 1/1995 | Weimer | 435/262 |
| 5,389,156 | 2/1995 | Mehta | 134/10 |
| 5,462,607 | 10/1995 | Mesteskey et al. | 134/12 |
| 5,529,930 | 6/1996 | Montcello et al. | 208/44 |
| 5,807,476 | 9/1998 | Collins et al. | 208/236 |

FOREIGN PATENT DOCUMENTS

WO 93/05187 3/1993 WIPO .

OTHER PUBLICATIONS

Zyme Flow/United 655 WWT Super Concentrate Enzyme–Based Grease Pre–Digester (English #390), United Laboratories.

Zyme Flow/United 656 Marine Super Concentrated Enzyme–Based Grease Pre–Digester (English #191), United Laboratories.

Zyme Flow/United 656 Marine Super Concentrated Enzyme–Based Grease Pre–Digester (Spanish #191), United Laboratories.

Zyme Flow/United 655 WWT Super Concentrate Enzyme–Based Grease Pre–Digester (Spanish #791), United Laboratories.

Zyme Flow/United 657 Refinery Super Concentrated Enzyme–Based Grease Pre–Digester (Spanish), United Laboratories.

*Primary Examiner*—Helane Myers
*Attorney, Agent, or Firm*—Thomas R. Weaver

[57] ABSTRACT

A method of removing hazardous sulfur compounds, such as hydrogen sulfide, mercaptans and sulfur oxides, from a fluid stream comprising contacting the fluid stream with an aqueous composition comprised of a tertiary amine oxide. The amine oxide reacts with the hazardous sulfur compounds to eliminate the compounds from the fluid stream.

21 Claims, 2 Drawing Sheets

METHOD OF REMOVING SULFUR COMPOUNDS FROM HYDROCARBON STREAMS

This is a continuation-in-part of application Ser. No. 08/541,611 filed Oct. 10, 1995, now 5,807,476 which is a continuation-in-part of application Ser. No. 08/228,575 filed Apr. 15, 1994, now U.S. Pat. No. 5,462,607.

BACKGROUND OF THE INVENTION

1. Technical Field of the Invention

This invention broadly relates to the treatment of sulfur compounds and, more particularly, to the removal thereof from hydrocarbons. The invention still further relates to the removal of sulfur compounds from a fluid hydrocarbon at a time prior to the use of the fluid hydrocarbon as a fuel or as precursor to a subsequent industrial process.

2. Description of the Prior Art and Problems Solved

Sulfur compounds, for example, hydrogen sulfide, mercaptans and sulfur oxides, such as sulfur dioxide and sulfur trioxide, can be produced by natural forces and as by-products of industrial processes. Such compounds, when occurring at certain concentration levels, and, particularly, when released in the gas phase to the atmosphere, are deemed to be at least offensive and, at times, a hazard to the environment. In fact, such compounds are sometimes referred to in the art as "hazardous sulfur compounds" and they are referred to as such herein.

As a consequence of the offensive nature of, and potentially environmental and safety problems posed by, hazardous sulfur compounds their release to the atmosphere has been addressed by governmental entities. Accordingly, hydrogen sulfide and sulfur dioxide are the subjects of 40 C.F.R. §65, and 40 C.F.R. §80, respectively.

Certain hazardous sulfur compounds, particularly hydrogen sulfide and mercaptan compounds, are known to occur with fluid hydrocarbons in earthen formations, such as coal beds and subterranean formations which contain oil and/or gas. It is, thus, well known that hazardous sulfur compounds can be dissolved or dispersed in fluid hydrocarbons recovered from such formations and/or separately produced with such hydrocarbons in the gas phase. Regardless of the form of occurrence, and particularly in the case of high concentrations thereof, it has long been important that hazardous sulfur compounds be handled and treated using methods designed to prevent their release, for example, as a gas, to the environment. For purposes of this disclosure, "fluid hydrocarbons" are defined to mean hydrocarbons which occur in the liquid phase, such as crude oil, and hydrocarbons which occur in the gas phase, such as natural gas. Still further, a fluid hydrocarbon containing hydrogen sulfide and/or mercaptans is referred to herein as being "sour." For example, crude oil and natural gas which are recovered from earthen formations and coal beds together with hydrogen sulfide and/or mercaptans have been referred to in the art as "sour" crude and "sour" gas and are referred to as such herein.

In addition to the natural occurrence of hazardous sulfur compounds with crude oil and natural gas, such compounds can also be produced in industrial operations and can result in contamination of refined fluid hydrocarbon products, such as jet fuel, heating oil, petrochemical feedstocks and the like.

Various methods and processes are, and have been, employed to treat hazardous sulfur compounds to prevent their release to the environment. According to some processes, such treatments are conducted at a time when the sulfur compounds are dissolved or dispersed in or otherwise intimately associated with fluid hydrocarbons before the hydrocarbon streams are subjected to refinery operations, used as a fuel or used as a precursor for subsequent operations. Such operations are referred to herein as "upstream" treatments. Other treatments, referred to herein as "down stream" treatments, are conducted after the fluid hydrocarbons have been refined, or used as a fuel or employed as a precursor for the manufacture of hydrocarbon-based products. At such times the fluid streams to be treated are ordinarily waste streams comprised of products of combustion including, hazardous sulfur compounds in the form of sulfur dioxide and sulfur trioxide gas. Flue gas is an example of such waste streams.

SUMMARY OF THE INVENTION

By this invention, hazardous sulfur compounds are converted to non-volatile, sulfur-containing species which are not soluble in hydrocarbons. The conversion is performed by contacting the hazardous sulfur compounds with a composition comprising an amine oxide. The non-volatile species, thus formed, can be dissolved or dispersed in water to enable their disposal in a manner consistent with acceptable environmental practice.

It is believed that the contact between the composition and the hazardous sulfur compounds, and, thus, the conversion, can be effected in processes featuring upstream and down stream treatments, as previously defined. However, the contact is conveniently, and therefore, preferably, performed in an upstream method, comprised of: contacting a fluid hydrocarbon containing a hazardous sulfur compound, or compounds, dissolved or dispersed therein, with an aqueous composition comprising an amine oxide, or, preferably, comprising a combination of an amine oxide and an enzyme, or enzymes; maintaining the contact for a time sufficient to convert the hazardous sulfur compound to a non-volatile, sulfur-containing species which is not soluble in the fluid hydrocarbon and soluble, or at least dispersible, in water; and permitting the sulfur-containing species to disperse into the water phase of the aqueous composition whereby the sulfur-containing species is removed from the fluid hydrocarbon. In subsequent steps, the fluid hydrocarbon and water phase, having the sulfur species dispersed or dissolved therein, referred to herein as being "bound in the water phase," can be separated by well known phase separation techniques based upon the immiscibility of water and oil.

An "upstream" process illustrative of the invention is provided below in connection with specific embodiments for treating sour crude, sour gas and mixtures thereof.

DESCRIPTION OF THE PREFERRED EMBODIMENTS

Figure 1:
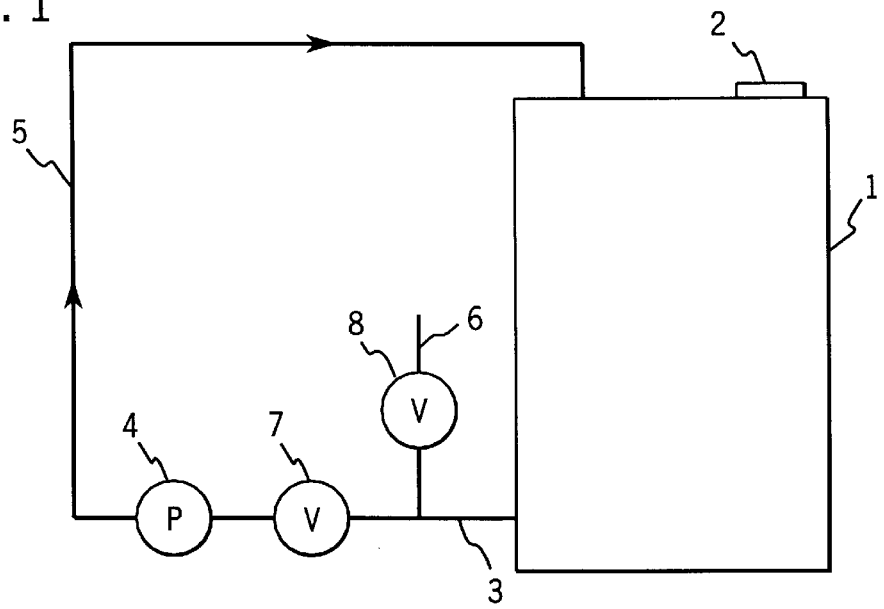
FIG. 1 is a schematic representation illustrating a method of performing the invention to remove hazardous sulfur compounds from a liquid hydrocarbon.

Naturally occurring fluid hydrocarbons, such as crude oil and natural gas, which contain a substantial concentration of sulfur compounds, such as hydrogen sulfide and mercaptans are referred to as "sour". These hazardous sulfur compounds are evolved from the sour crude oil or sour natural gas over an extended period of time, and not only create a serious environmental and safety problem, but also attack the metal components of production equipment such as well casing, tubing, pumps, pump rods, pipelines and storage tanks, causing brittleness and/or corrosion of the metal components.

The service life of a well casing in a well producing sour crude oil and/or sour natural gas is generally less than about five years; the service life of the actuating rod (pump rod), pump and tubing within the well may only be on the order of several months. The replacement of these components, such as the pump, pump rod, tubing and other mechanical equipment, not only results in a substantial expenditure for the replacement parts, but also results in considerable down time for the well.

In some instances sour crude oil and/or sour natural gas (which ordinarily occur together in various ratios) may be treated by chemical and/or mechanical processing, to reduce the concentration of the hazardous sulfide compounds to an acceptable level. However, since such processing requires a substantial capital expenditure for the processing equipment, it is often economically unfeasible to reduce the concentration of the hazardous compounds to an acceptable level. Thus, sour crude oil, even after treatment to reduce the content of the sulfur compounds will be unacceptable for many usages, with the result that the crude oil will be sold for a lesser price. In other situations, where the sour crude oil or natural gas has an extremely high level of sulfur compounds, it is unfeasible to utilize the oil or gas, with the result that the well is merely plugged and abandoned.

Certain industrial and household cleaners, as well as laundry detergents, contain a mixture of enzymes and surfactants, which act in aqueous compositions to disperse organics, such as grease, oil, or other soil in water. The enzymes operate to attack or degrade organics such as grease, oil, or other soil, and can include one or more of a combination of proteases, amylases, lipases, cellulases, and pectinases. The surfactants operate to disperse the degraded particles in the aqueous phase, and can contain both hydrophilic and oleophilic groups. According to the dispersion mechanism, an oleophilic group on a surfactant molecule will attach to a particle of the oil, grease, or other soil, while a hydrophilic group on the surfactant molecule is attracted by water. The particle is thus caused to disperse in water. The particle dispersion is maintained because the hydrophilic groups on different surfactant molecules repel each other which necessarily results in the repulsion between the particles of oil, grease, and soil.

One use of cleaning compositions containing enzymes and a surfactant, as described above, is to remove soiled lubricant from the surface of industrial equipment and machinery. This use features contacting the surface to be cleaned with high velocity streams, that is, jets, of an aqueous composition containing a surfactant and enzymes, to thereby remove the soiled lubricant from the surface and produce residual wash water containing the soiled lubricant, consisting of oil, grease, dirt, metal chips, and the like, which are dispersed throughout the residual wash water.

It has also been recognized, as disclosed in WO 93/05187, that the addition of an amine oxide and enzymes to oily waste water will result in the separation of an oil phase from the water phase when the waste water is permitted to stand in a quiescent state.

In one aspect, the invention is, thus, broadly related to a method of removing certain hazardous sulfur compounds from fossil fuels, such as crude oil and natural gas, by contacting the fuels with an aqueous composition comprising an amine oxide, and preferably, a combination of an amine oxide and enzymes.

In one embodiment of the invention, the aqueous composition is added to sour crude oil in a storage tank or vessel, and preferably mixed with the oil by pumping the oil from the lower portion of the tank and recirculating it to the upper portion.

In a second embodiment of the invention, the aqueous composition is added in stream to sour crude oil at the wellhead, either by injecting the composition into the pipeline through which the oil is flowing from the well, or by feeding or dripping the composition into the casing of the well, in which case, the composition will flow downwardly along the inner surface of the casing and mix with the oil in the well and the mixture will be drawn upwardly through the tubing to the wellhead.

In still another embodiment of the invention, sour natural gas can be treated by flowing the gas through a treating vessel in countercurrent relation to a spray of the aqueous composition.

The quantity of composition added to the crude oil and/or natural gas is not critical and depends on the level of concentration of the sulfur compounds in the hydrocarbon. Accordingly, the composition can be added to the sour crude oil or sour natural gas in a ratio of about 1 part by weight of composition to a quantity 1 to 15000 parts by weight of the crude oil or natural gas.

As mentioned, the fluid hydrocarbon containing a hazardous sulfur compound to be removed therefrom is conveniently contacted with the composition in aqueous form. Thus, the ratio of water to composition in the aqueous composition is an amount in the range of from about 2 to about 80000, preferably from about 3 to about 1000, more preferably in the range of from about 4 to about 12 parts by weight water per one part by weight of composition. A particularly useful aqueous composition features about 8 parts by weight water per one part by weight composition.

The composition of this invention, as previously mentioned, can be a combination of an amine oxide and enzymes. Accordingly, the use of enzymes in combination with amine oxide to form the composition is not required. However, in a typical application containing amine oxide and enzymes, the composition may contain in the range of from about 0.9 to about 12 parts by weight of amine oxide to one part by weight of enzymes.

It is believed that the amine oxide reacts with the hazardous sulfur compounds to form reaction products which are non-volatile, sulfur-containing species which are not soluble in hydrocarbons. It is further believed that the reaction product is bound in the water phase. The net result is that evolution of the sulfur compounds from the crude oil or natural gas is prevented.

It is further believed that the enzymes, when utilized, act as a catalyst to increase the reaction rate.

The incorporation of the composition with the sour crude oil or sour natural gas does not have any deleterious effect on the oil or gas, and the composition appears to selectively react with the sulfur compounds.

By reducing the content of the sulfur compounds in the sour crude oil or sour natural gas, the evolution of these compounds from the oil or gas is reduced or eliminated, thus reducing the need for expensive pollution control equipment, which would normally be necessary in order to prevent the hazardous compounds from entering the atmosphere.

The elimination of the sulfur compounds from the sour fossil fuel also prevents the embrittlement and/or corrosion of metal components of the well, as well as pipelines, storage tanks, and the like, thus greatly increasing the service life of these components.

In accordance with the invention, the sour crude oil or sour natural gas is treated with an aqueous composition, either in liquid or vaporized form, comprising an amine oxide or, preferably, comprising a combination of an amine oxide and enzymes. The amine oxide useful in the invention is a water soluble, amphoteric material having an HLB (hydrophilic lipophilic balance) of 8 to 14. More particularly, the amine oxide is a tertiary amine oxide represented by the following formula:

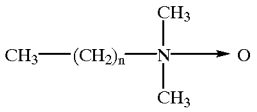

where n has a value in the range of from about 6 to about 20. Specific examples of amine oxides within the scope of the above formula are lauryl dimethylamine oxide, stearyl dimethylamine oxide, myristyl dimethyl amine oxide, and mixtures thereof. The preferred surfactant of this group is lauryl dimethylamine oxide.

A method of preparing tertiary amine oxides is disclosed in French Patent 1,378,770, entitled "Preparation of tertiary amine oxides."

The enzymes that can be employed in the composition with the amine oxide are selected from the group consisting of proteases, amylases, lipases, cellulases, pectinases, and mixtures thereof.

Preferably, the enzyme is selected from the group consisting of bacterial protease from *Bacillus subtilis*, amylase from *Bacillus subtilis*, lipase from *Aspergillus niger*, cellulase from *Aspergillus niger*, pectinase from *Aspergillus niger*, and mixtures thereof. More preferably, the method of the present invention utilizes an enzyme mixture of protease from *Bacillus subtilis*, amylase from *Bacillus subtilis*, lipase from *Aspergillus niger*, cellulase from *Aspergillus niger*, and pectinase from *Aspergillus niger*. A mixture of enzymes of this type is sold by Applied Biochemists, Inc., Milwaukee, Wis. under the trademark "AMERZYME-A-100".

More particularly, "AMERZYME-A-100 contains 150 FCC/gm lipase, 320 PC/gm protease, 1350 BAU/gm bacterial amylase, and 320 C-ASE/gm cellulase, all of which are fungal in origin.

The amount of the composition to be incorporated with the sour crude oil or sour natural gas is not critical, and depends largely on the concentration of the sulfur compounds, such as hydrogen sulfide and mercaptans. In practice, the composition can be used in a weight ratio of 1 part composition to 1 to 15,000 parts of sour crude oil or sour natural gas, based on 100% active ingredients. The enzymes can be used in a weight ratio of about 0.9 to about 12 parts of amine oxide to one part of enzyme, based on 100% active ingredients.

Referring now to FIG. 1, sour crude oil is contained within a tank or vessel 1, having an upper removable hatch 2. An outlet line 3, is connected to the lower portion of tank 1 and is connected to the suction side of a pump 4, while a discharge line 5 from pump 4 is connected to the upper end of tank 1. A supply line 6, for purposes of sales, is connected to line 3 and valves 7 and 8 are mounted in lines 3 and 6, respectively.

With this construction, an aqueous composition of this invention is fed into tank 1 through the open hatch 2. Valve 7 is open, while valve 8 is closed, and pump 4 is operated causing the oil to be drawn from tank 1 from the outlet line 3 and recirculated through line 5 to the upper end of the tank. This circulation will cause intimate mixing and contact between the composition and the sour crude oil. In practice, the pumping can continue for a time sufficient to replace three volumes of the tank, and preferably about five volumes.

During this circulation, the amine oxide will react with the sulfur compounds contained in the crude oil, and it is believed that the enzymes will catalyze the reaction. The reaction products are believed to be bound in the water phase of the aqueous composition, thus minimizing or eliminating the evolution of the hazardous sulfur compounds from the sour crude oil.

While circulation of the crude oil containing the composition is preferred in order to obtain intimate mixing, in other situations the composition can be fed into the body of crude oil and over a period of time dispersion of the composition throughout the oil will occur.

Figure 2:
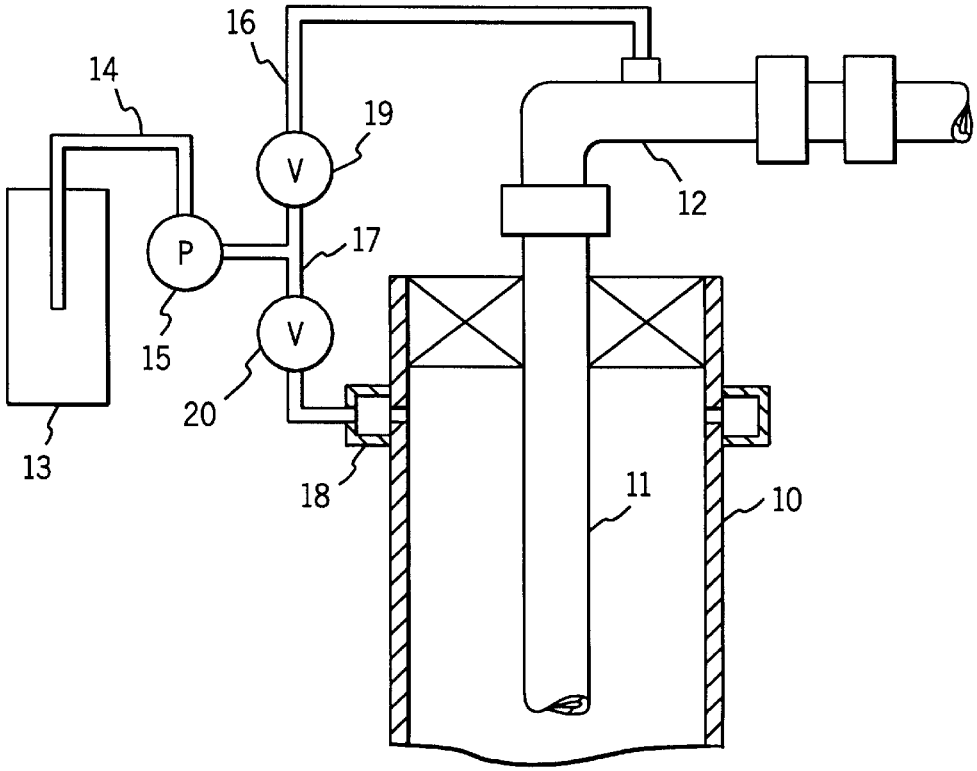
FIG. 2 is a schematic drawing illustrating a second embodiment of the invention of the method shown in FIG. 1.

FIG. 2 represents a second modified form of the invention, in which an aqueous composition of this invention is added to the sour crude oil at the wellhead. FIG. 2 illustrates a typical free flowing well having an outer casing 10 and a central concentric tube 11, which is sealed to the casing and extends upwardly through the wellhead and is connected to a pipeline 12.

The composition is contained within a container or tank 13, and the tank is connected via line 14 to the suction side of a pump 15. The discharge side of pump 15 is connected to lines 16 and 17. Line 16 is connected to pipeline 12, while line 17 is connected to a distribution collar 18 that is mounted on the upper end of the casing 13. Suitable valves 19 and 20 are mounted in lines 16 and 17.

With the construction of FIG. 2, when valve 19 is open and valve 20 is closed, the composition will be pumped through line 16 and fed into the sour crude oil flowing within pipeline 12. The circulation of the crude oil in the pipeline will cause intimate mixing of the treating composition with the crude oil. Alternately, valve 19 can be closed and valve 20 open, in which case the treating composition will be fed to the distribution collar 18, where it will be sprayed or dripped through ports or nozzles in casing 10 into the annular space between the casing and tube 11. The composition will flow downwardly along the inner wall of casing 10, as well as along the outer wall of tube 11, and will mix with the crude oil at the bottom of the well. The mixture will then be drawn upwardly through the tube 14 to the wellhead.

As in the case of the embodiment illustrated in FIG. 1, the composition will react with the sulfur compounds in the sour crude oil, and the reaction products are believed to be bound in the aqueous phase, thus preventing evolution of the hazardous compounds from the crude oil. As the evolution of the compounds, such as hydrogen sulfide, is minimized or eliminated, the process minimizes the necessity of expensive pollution equipment that would normally be required to reduce the hazardous sulfur compounds in the crude oil to an acceptable level.

Further, by eliminating the sulfur-containing compounds in the crude oil, the possibility of these compounds attacking the metal components of the well, the pipeline, or storage tanks is eliminated. Thus, the service lives of the well components and the pipeline and storage tanks are substantially increased.

Figure 3:
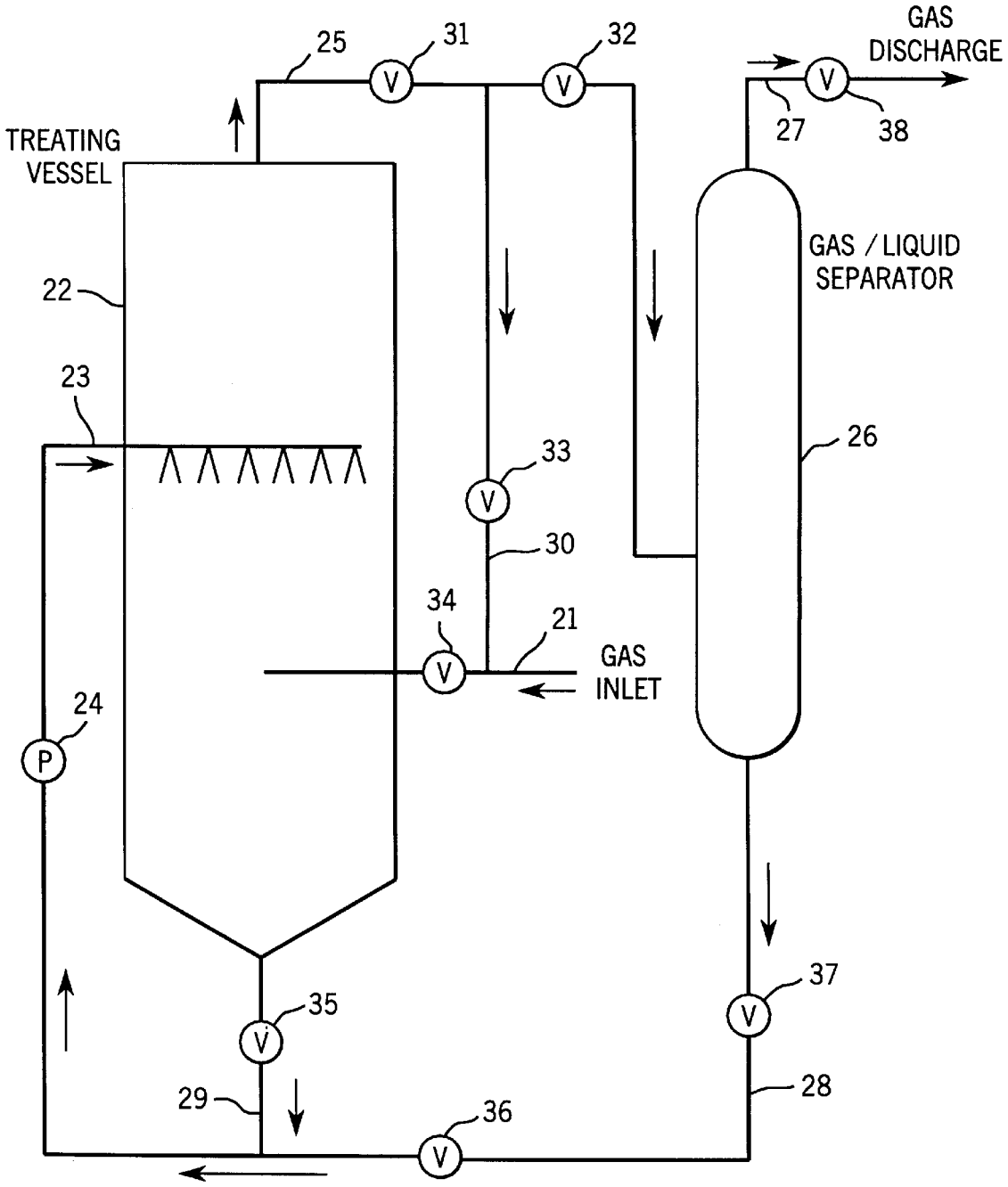
FIG. 3 is a schematic drawing illustrating a method of performing the invention to remove hazardous sulfur compounds from a hydrocarbon in the gas phase.

FIG. 3 schematically illustrates the method of the invention as utilized to remove sulfur compounds from sour natural gas. The sour natural gas flowing in line 21 is introduced into the central portion of a generally vertical treating vessel 22. An aqueous composition comprising amine oxide, and, preferably, comprising amine oxide and enzymes, is pumped through line 23 into the upper portion of vessel 22 by pump 24, and sprayed downwardly through a plurality of jets or nozzles in counter current relation to the upward flow of the sour natural gas. Suitable baffles or trays can be incorporated in the treating vessel 22 to increase the contact time between the aqueous composition and the gas.

As previously described, the amine oxide will react with the sulfur compounds in the sour natural gas and it is believed that the reaction products will be bound in the water phase. The enzymes, if utilized, act to catalyze the reaction.

The treated natural gas containing water vapor is discharged from the upper end of vessel 22 through line 25, and is introduced into the central portion of a gas/liquid separator 26. Separator 26 is a conventional type and serves to separate the natural gas from the water vapor. The treated gas is discharged from the separator through line 27, while the condensed water vapor exits separator 26 through line 28, which is connected to the suction side of pump 24. In addition, the composition discharged from the lower end of vessel 22 is connected to return line 28 via line 29. Thus, the composition is discharged from vessel 22 and can be recycled back to the treating vessel through lines 28 and 23 along with the liquid separated from the gas in separator 26.

In addition, a line 30 can be connected between the gas discharge line 25 and the gas inlet line 21, so that if desired, the gas and water vapor being discharged from the treating vessel 22 can be recirculated to the treating vessel as opposed to being discharged to the separator. Suitable valves 31–38 can be incorporated in the system to control the flow of the gas and treating composition.

The method described in connection with FIG. 3 illustrates the removal of sulfur compounds from a gaseous media, such as sour natural gas, thus eliminating or minimizing the necessity of incorporating expensive pollution control equipment that would normally be required to reduce the sulfur compounds in the natural gas to an acceptable level.

Having thus described the invention that which is claimed is:

1. A method of removing hazardous sulfur compounds from a fluid stream comprising contacting a fluid stream containing hazardous sulfur compounds with an aqueous composition comprising a tertiary amine oxide represented by the formula

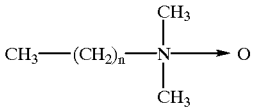

where n has a value in the range of from 6 to 20;

maintaining said contact for a time sufficient to permit said composition to react with said compounds to form non-volatile, sulfur-containing species; and binding said non-volatile species in the water phase of said aqueous composition to thereby remove said hazardous sulfur compounds from said fluid stream.

2. The method of claim 1 wherein said fluid stream is a fluid hydrocarbon and said hazardous sulfur compounds are selected from hydrogen sulfide, mercaptans and sulfur oxides.

3. The method of claim 2 wherein said fluid hydrocarbon is a fossil fuel selected from the group consisting of sour crude oil, sour natural gas and mixtures thereof and said hazardous sulfur compounds are selected from hydrogen sulfide, mercaptans and mixture thereof.

4. The method of claim 3 wherein said fossil fuel is sour crude oil and said method further comprises flowing said crude oil through a conduit, wherein said contacting step comprises adding said composition to said crude oil in said conduit.

5. The method of claim 3 wherein said fossil fuel is sour crude oil and said method further comprises storing said crude oil in a vessel, wherein said contacting step comprises adding said composition to said crude oil in said vessel to form a mixture, and, thereafter, circulating said mixture in said vessel.

6. The method of claim 3, wherein said fossil fuel is sour crude oil and said method further comprises withdrawing said crude oil from a well through an inner tube spaced radially inward from an outer well casing, introducing said composition into the annular space between said inner tube and said casing and flowing said composition downwardly along an inner wall of said casing to mix with said crude oil in said well.

7. The method of claim 3, wherein said composition is further comprised of enzymes.

8. The method of claim 7, wherein the weight ratio of said amine oxide to said enzymes in said composition is an amount in the range of from about 0.9 to 12 parts by weight of said amine oxide per 1 part by weight of said enzymes, based on 100% active ingredients.

9. The method of claim 3 wherein said fossil fuel is sour natural gas and said contacting step comprises spraying said sour natural gas with said aqueous composition.

10. A method of removing hazardous sulfur compounds from crude oil, comprising the steps of flowing crude oil containing hazardous sulfur compounds through a conduit, adding to said crude oil flowing in said conduit an aqueous composition comprising a tertiary amine oxide having the formula:

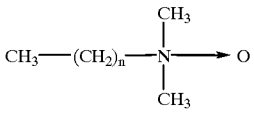

where n is 6 to 20, to thereby place said composition in contact with said crude oil, maintaining said contact for a time sufficient to permit said composition to react with said compounds to form a reaction product which disperses into the water phase of said aqueous composition to thereby remove said hazardous sulfur compounds from said crude oil.

11. The method of claim 10 wherein said composition is further comprised of enzymes selected from the group consisting of proteases, amylases, lipases, cellulases and pectinases, and mixtures thereof.

12. A method of removing hazardous sulfur compounds from crude oil, comprising the steps of withdrawing crude oil containing hazardous sulfur compounds from a well through an inner tube spaced radially inwardly from an outer well casing;

introducing a composition comprising amine oxide into the annular space between said tube and said outer casing, said amine oxide having the formula:

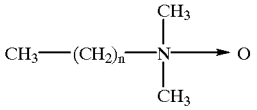

where n is 6 to 20;

flowing said composition downwardly along an inner surface of the casing to the bottom of said well; and mixing said composition with crude oil at the bottom of said well, said amine oxide reacting with said compounds in said crude oil to remove said compounds from said oil being withdrawn from said well.

13. The method of claim 12, including the step of incorporating enzymes selected from the group consisting of proteases, amylases, cellulases, lipases, and pectinases and mixtures thereof, with said amine oxide to form a mixture, said enzymes acting to catalyze said reaction.

14. The method of claim 13, wherein said amine oxide and said enzymes are in aqueous solution and said amine oxide is present in a weight ratio of 0.9 to 12 parts of said amine oxide to one part of said enzymes based on 100% active ingredients.

15. The method of claim 14, wherein said composition is sprayed into the space between said tube and said outer casing.

16. A method of removing hazardous sulfur compounds from sour crude oil, comprising the steps of storing sour crude oil containing hazardous sulfur compounds in a storage vessel, adding to said sour crude oil in said vessel an aqueous solution comprising an amine oxide having the formula:

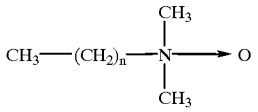

where n is 6 to 20, circulating said crude oil containing said aqueous solution of said amine oxide in said vessel to effect a reaction between said amine oxide and said sulfur compounds to produce a reaction product and binding said reaction product in the water phase of said aqueous solution.

17. The method of claim 16, including the step of incorporating enzymes selected from the group consisting of proteases, amylases, lipases, cellulases and pectinases, and mixtures thereof, with said amine oxide in said aqueous solution, said enzymes acting to catalyze said reaction.

18. A method of removing hazardous sulfur compounds from sour natural gas, comprising the steps of flowing sour natural gas containing gaseous sulfur compounds in contact with a water solution of an amine oxide having the formula

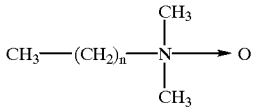

where n is 6 to 20, and reacting said amine oxide with said compounds to form non-hazardous reaction products.

19. The method of claim 18 and including the step of incorporating with said amine oxide in said water solution enzymes selected from the group consisting of proteases, amylases, lipases, cellulases, pectinases, and mixtures thereof.

20. The method of claim 19 wherein said sour natural gas is flowed through a treating vessel in contact with a vaporized spray of said water solution.

21. The method of claim 20, including the further step of separating the natural gas from vaporized water.

* * * * *